US005493959A

United States Patent [19]

Yagi et al.

[11] Patent Number: 5,493,959

[45] Date of Patent: Feb. 27, 1996

[54] APPARATUS FOR CORRECTING SLIDE BOTTOM DEAD CENTER POSITION OF MECHANICAL PRESS

[75] Inventors: Takashi Yagi; Mitsuo Sato, both of Sagamihara, Japan

[73] Assignee: Aida Engineering, Ltd., Sagamihara, Japan

[21] Appl. No.: 291,907

[22] Filed: Aug. 18, 1994

[30] Foreign Application Priority Data

Aug. 23, 1993 [JP] Japan ..... 5-207414

[51] Int. Cl.[6] ..... B30B 15/14

[52] U.S. Cl. ..... 100/43; 72/446; 83/530; 100/257

[58] Field of Search ..... 100/43, 48, 214, 100/257, 282; 72/446, 452, 465; 74/581, 583, 586; 83/530, 628, 640

[56] References Cited

U.S. PATENT DOCUMENTS 4,377,084 3/1983 Kaminski ..... 72/325

FOREIGN PATENT DOCUMENTS 1-30569 6/1989 Japan .
1-55056 11/1989 Japan .

*Primary Examiner*—Stephen F. Gerrity
*Attorney, Agent, or Firm*—Steven M. Rabin

[57] ABSTRACT

An apparatus for rapidly and accurately correcting the bottom dead center position of the slide of a mechanical press during the operation of the press. The apparatus includes a hollow cylindrical member, disposed between a slide and a die-height adjusting screw mechanism, that can be expanded or contracted along its axis. Also provided are a bottom dead center position setter, a bottom dead center position detector for detecting a bottom dead center position of the slide, and a force applying unit which supplies a contraction force to the hollow cylindrical member. A correction control unit controls the force applying unit to expand or contract the hollow cylindrical member in order to correct the slide bottom dead center position, so that a detected bottom dead center position coincides with the set bottom dead center position.

5 Claims, 6 Drawing Sheets

APPARATUS FOR CORRECTING SLIDE BOTTOM DEAD CENTER POSITION OF MECHANICAL PRESS

BACKGROUND OF THE INVENTION

1. Field of the Invention

Mechanical presses that use dies to manufacture parts, produce heat during their operation. As a result, the temperatures of respective parts increase, and if the mechanical press is stopped, its temperature drops to the ambient temperature by radiation of heat. However, the degrees of temperature change differ among the respective components constituting the mechanical press. Thus, differences of the temperatures are produced among the respective parts, so that differences in the amount of heat expansion occur among the respective parts. The position of the bottom dead center of the slide (that is, the lowest position of the slide during a stroke by the press) is changed because of the differences in the amount of heat expansion. Consequently, the die height of the mechanical press is changed. The change of the die height adversely affects the accuracy of parts which are produced by the press. The present invention relates to a method for minimizing the change of the die height, or the change of the point of bottom dead center of the slide, so the press can produce parts with a high degree of accuracy.

2. Description of Related Art

The following three methods for minimizing the change of the bottom dead center point of the slide have been proposed:

a) Japanese Patent Publication No. 30569/1989 discloses a method in which oil of a predetermined temperature is splashed on connecting rods that experience a large change of the temperature. However, when this method is applied, it is difficult to maintain the position of the bottom dead center of the slide accurately when the mechanical press is operated in such a manner that changes in the amount of generated heat occur. Changes in heat generation may occur, for example, when the SPM (press speed in strokes per second) is changed or when the cycle of startup/stop operation, and the duration of the cycles are changed.

b) Japanese Patent Publication No. 55056/1989 discloses a method in which a stopper block is disposed between a slide and a bed so that they correspond to each other. The stopper block is hit each time the bottom dead center is reached, in order to restrict the position of the bottom dead center point. According to this method, the position of the bottom dead center can be restricted accurately if the elasticity of the stopper block is high. However, an increase in elasticity causes variations in the load applied to the mechanical press to increase. Therefore, the mechanical press may be damaged. If the elasticity of the stopper block is low, it is not possible to control the position of the bottom dead center accurately.

c) FIG. 7 illustrates another method for maintaining the position of the bottom dead center at a constant position. The method uses a die-height adjusting device employing a threaded connecting rod 11P, a threaded lock nut 22P, a slide 4, an adjusting screw 16P, a worm shaft 18, a worm wheel 19P and other parts. Adjusting screw 16P can be screwed into or out of connecting rod 11P when lock nut 22P is spaced apart from the bottom end of connecting rod 11P, but when lock nut 22P is screwed tightly against the bottom end of connecting rod 11P as shown it forces connecting rod 11P downward by a minute amount which is nevertheless sufficient to eliminate the normal clearance between the threads of connecting rod 11P and adjusting screw 16P, jamming the threads against one another. Although the lock nut 22P can be tightened to eliminate the normal clearance between the threads on the connecting rod 11P and the adjusting screw 16P, the die height cannot be adjusted until the lock nut 22P is loosened. Because it is not possible to restore the normal clearance of the threads unless the lock nut 22P is loosened, the mechanical press must be stopped during the adjustment of the die height. Further, the amount of adjustment for accurately maintaining the bottom dead center point at a constant position under changing temperature conditions during operation, is fine as compared with the amount of the adjustment of the die height which is ordinarily performed during an exchange of dies, or the like. Also, control of the lock nut 22P is necessary. An accurate adjustment therefore is difficult and takes a long time to perform.

As described above, there have been no methods in which the changes of the bottom dead center point can be adjusted accurately, regardless of whether the press is running or stopped, and previous methods lack part of the required functions.

SUMMARY OF THE INVENTION

An object of the present invention is to provide an apparatus for correcting the slide bottom dead center position, able to eliminate the disadvantages of the prior methods.

The die-height adjusting device includes an adjusting screw locking mechanism, and a shrink member or means and a contraction force applying means are incorporated between the die-height adjusting device and the slide.

The adjustment of the die height, which is performed during the down time of the mechanical press for die exchange or the like, is performed by means of the die-height adjusting device equipped with a locking mechanism which is similar to that employed in the prior method.

Fine adjustments for setting the bottom dead center at a constant point or position are performed by expanding or contracting the shrink member which elastically expands or contracts in the direction of changing the bottom dead center point by means of the contraction force applying means.

The shrink member can be expanded or contracted while the mechanical press is running as well as when the press is stopped.

Release of the adjusting screw is performed while the mechanical press is stopped. Such release is performed by releasing the contraction force applying means. Fixing the adjusting screw is achieved by actuating the contraction force applying means. Set values and detected values are input to a control unit by a bottom dead center position setting means for setting an objective bottom dead center position, and a bottom dead center position detecting means for detecting the actual bottom dead center position of the slide.

The control unit performs arithmetic operations on the basis of the entered set value, the detected value and values relative to previously entered elastic contraction.

The control unit controls driving of the contraction force applying means according to the result of the arithmetic operation, to expand or contract the shrink member and correspondingly adjust the bottom dead center position of the slide. In this way, die height is accurately maintained.

DESCRIPTION OF THE PREFERRED EMBODIMENTS

Embodiments of the present invention will be described with reference to the accompanying drawings.

First Embodiment

Briefly stated, the first embodiment of the bottom dead center position correcting apparatus according to the invention includes hollow, cylindrical shrink members, a contraction force applying means, and a correction control means. Each of the shrink members is expanded or contracted to automatically adjust the change of the bottom dead center position.

Figure 7:
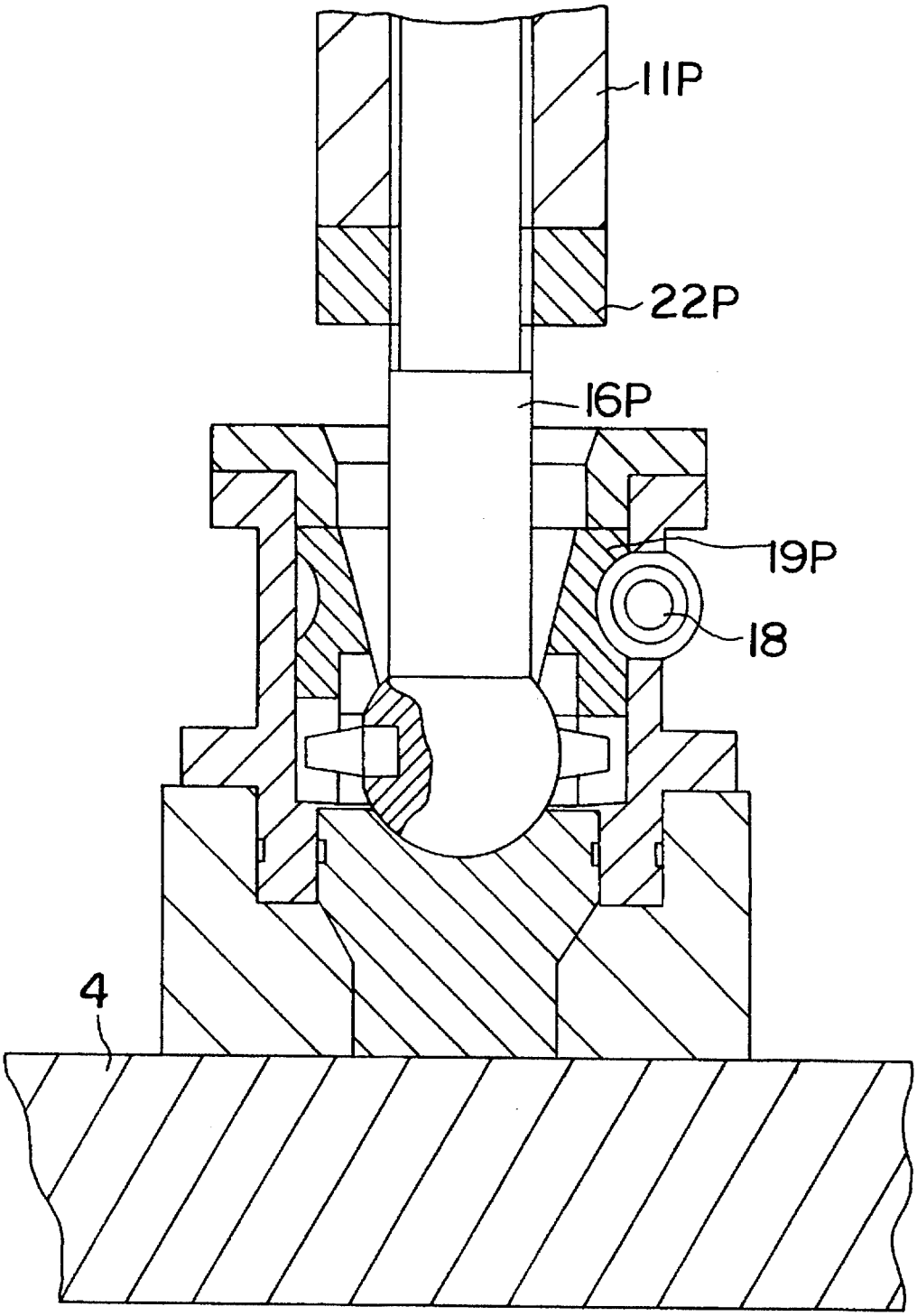
FIG. 7 PRIOR ART
FIG. 7 is a sectional view illustrating a prior bottom dead center position correcting apparatus.

Components common to the embodiment and conventional devices shown in FIG. 7 bear the same reference numerals, and the description thereof is omitted or simplified.

Figure 3:
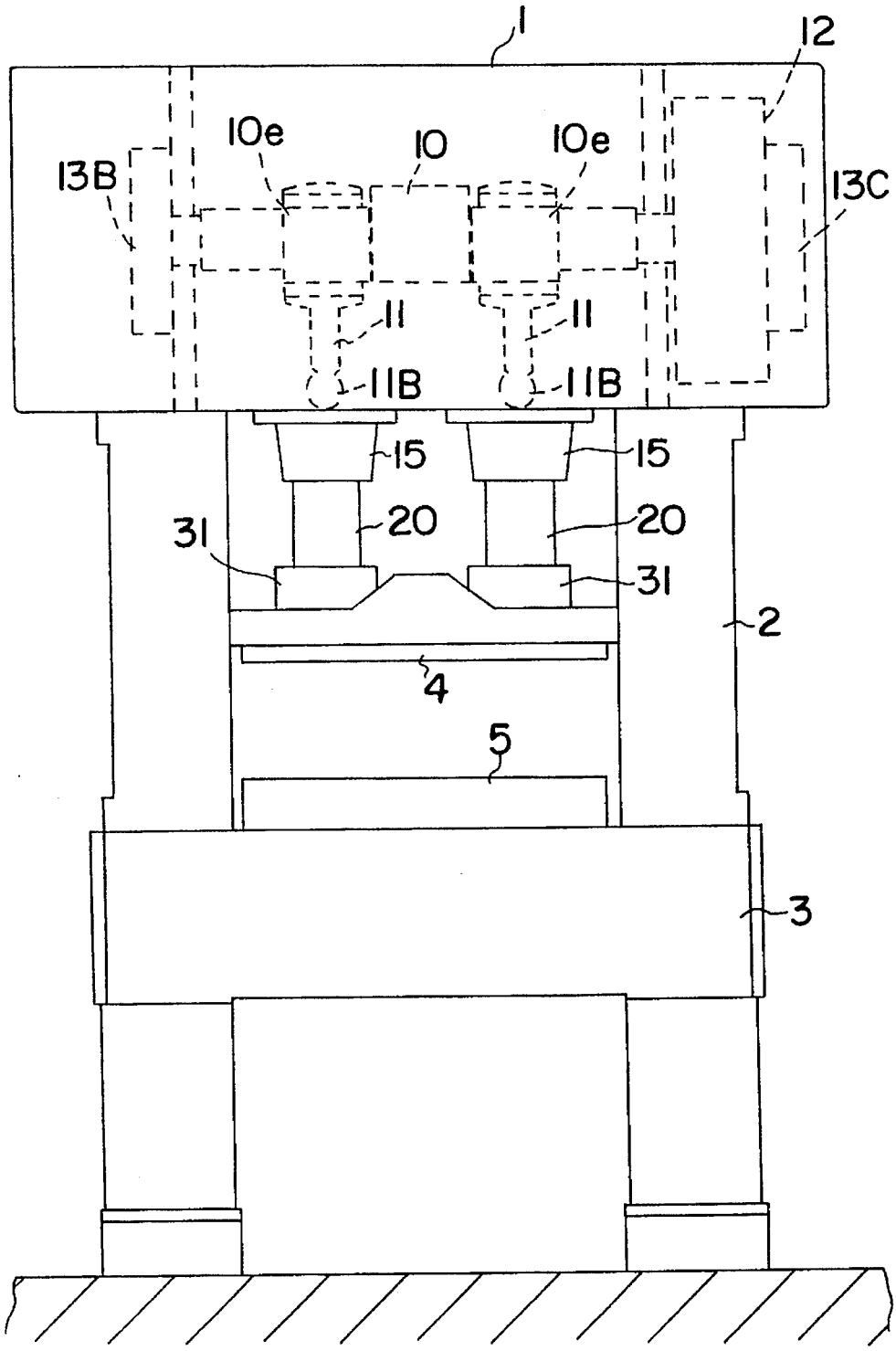
FIG. 3 is a view illustrating a mechanical press which employs the bottom dead center point correcting apparatus of the present invention.

A mechanical press containing an apparatus in accordance with a first embodiment of the invention will be described with reference to FIG. 3. Referring to FIG. 3, reference numeral 1 designates a crown, numeral 2 designates a column and numeral 3 designates a bed.

A crank shaft 10 having eccentric portions 10*e* is rotatably supported within the crown 1. A fly wheel 12, a clutch 13C and a brake 13B are mounted on the crank shaft 10. The clutch 13C transmits driving power from the fly wheel 12 to the crank shaft 10. A driving power source (not shown) for driving the fly wheel 12 is connected to the fly wheel 12.

A slide 4 is connected to the eccentric portions 10*e* of the crank shaft 10 through connecting rods 11 and hollow cylindrical shrink members 20 or the like. A bolster 5 is mounted on a bed 3. An upper die (not shown) is fixed on the bottom surface of the slide 4. On the other hand, a lower die (not shown) is fixed on the bolster 5.

While two each of eccentric portions 10*e*, connecting rods 11 and shrink members 20, etc. are illustrated in the preferred embodiment, embodiments with one or more than two are also contemplated. The description hereinafter is with respect to only one of such shrink members and related elements for adjusting and correcting the die height.

Figure 1:
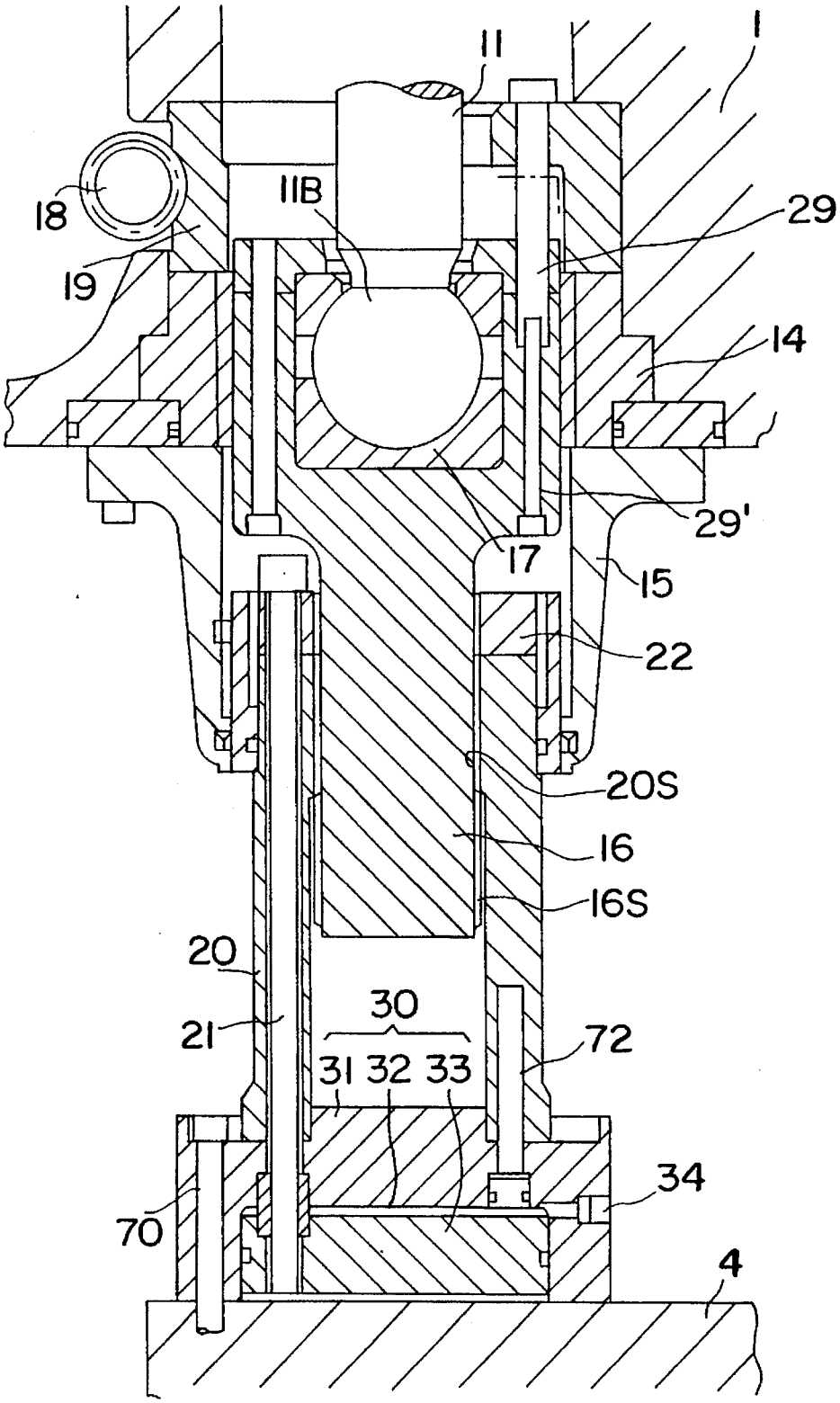
FIG. 1 is a sectional view illustrating the main parts of a first embodiment of the present invention.

The position of the aforementioned slide 4 is vertically adjustable while the press is stopped, by means of a die-height adjusting screw mechanism of a known slide position adjusting device. The slide 4 is fixed after the adjustment is finished. As shown in FIG. 1, the die-height adjusting screw mechanism comprises an adjusting screw shaft 16. The screw shaft 16 includes a spherical bearing 17 engaging with a spherical body 11B provided on the bottom end of the connecting rod 11. The screw mechanism is connected with a worm wheel 19, a lock nut 22 for fixing the adjusting screw 16, a worm screw shaft 18 which is engaged with the worm wheel 19, a motor (not shown) for driving the screw shaft 18, and the hollow cylindrical member 20. The upper portion of the hollow cylindrical member 20 is engaged with the adjusting screw shaft 16 through screw threads 16S, 20S. The bottom portion thereof is fixed to the slide 4 though a cylinder unit 30. The worm wheel 19 is connected to the screw shaft 16 by a vertically extending pin member 29' which is screwed into a sleeve member 29. In FIGS. 1 and 3, reference numeral 15 designates a case and numeral 14 designates a guide member.

To adjust the bottom dead center position, first pressurized oil within a cylinder chamber 32 of the cylinder unit 30 is released to eliminate a downward force on the lock nut 22 by a bolt member 21. During normal operation of the press the downward force on lock nut 22 locks adjusting screw shaft 16 to hollow cylindrical member 20 by jamming together the male screw thread 16S and the female screw thread 20S, but when the downward force on lock nut 22 is eliminated the screw shaft 16 becomes rotatable with respect to the look nut 22 and hollow cylindrical member 20. Then the worm screw shaft 18 is rotated so that the male screw thread 16S of the adjusting screw shaft 16 is rotated with respect to the female screw thread 20S of the hollow cylindrical member 20, through the worm wheel 19 and the members 29 and 29'. Thus, the slide 4 is moved vertically to adjust the bottom dead center position.

The shrink means of the bottom dead center position correcting apparatus of the present invention is provided between the slide 4 and the die-height adjusting mechanism so as to be able to expand or contract along the axis. In this embodiment, the shrink means comprises the hollow cylindrical shrink member 20.

The bottom dead center position adjustment is performed to set a bottom dead center position indirectly according to the die height. Digital switches are used to output a set bottom dead center position signal Ps indicative of the actual die height at bottom dead center.

The bottom dead center position detecting means 45 is used for detecting the bottom dead center position of the slide 4. The bottom dead center position detecting means 45 employs a known high-frequency oscillating type eddy-current detecting method. According to this method, the position of the slide 4 with respect to the bolster is output using absolute type electric signals.

The contraction force applying means is a means for elastically deforming the hollow cylindrical member 20 by applying a contraction force to the hollow cylindrical member 20, and comprises the bolt member 21, the cylinder unit 30 and a hydraulic pressure supplying port 34 of the hydraulic pressure supply means, a directional control valve 36 (servo valve) and a hydraulic supply source (not shown), or the like.

The cylinder unit 30 comprises a cylinder 31 fixed on the slide 4 by a bolt 70 and to the bottom of the cylindrical member 20 by a bolt 72. A piston 33 is incorporated within the cylinder chamber 32 of the cylinder 31 so that the piston 33 is vertically movable. The heights of spaces shown in FIG. 6 above and below the piston 33 are exaggerated to facilitate understanding that the piston 33 is vertically movable within the cylinder 31. The cylinder 31 receives hydraulic pressure between the top face of the cylinder chamber 32 and the piston 33, through the hydraulic fluid supply port 34.

The bolt member 21 is installed within the hollow cylindrical member 20 and can move vertically with respect thereto. The bottom end of the bolt member 21 is fixed to the piston 33 and the top end thereof is integratedly connected to the lock nut 22.

The hydraulic pressure supply means is formed so as to be able to supply to the cylinder chamber 32 of the cylinder unit 30, hydraulic pressure of a predetermined pressure value between a minimum pressure Pr0 and a maximum pressure Pr2. The hydraulic pressure supply means is provided at the hydraulic pressure source (not shown). A pipe connects the hydraulic pressure source with the hydraulic pressure supply port 34 of the cylinder 31. The hydraulic pressure supply means comprises an electrically controlled hydraulic pressure servo valve 36. The valve 36 has an electrically controllable hydraulic pressure servo mechanism for controlling the internal pressure of the cylinder chamber 32 to be in proportion to an electric input signal. The hydraulic pressure supply means also includes a pressure sensor 35, a servo amplifier and the like.

When hydraulic pressure is supplied into the cylinder chamber 32, the bolt member 21 is pulled in a downward direction. The bolt member 21 therefore is stretched because the top end thereof is fixed to the hollow cylindrical member 20 through the lock nut 22. This causes the hollow cylindrical member 20 to contract. As a result, the slide 4 is moved upward by the amount of the contraction of the hollow cylindrical member 20.

Figure 4:
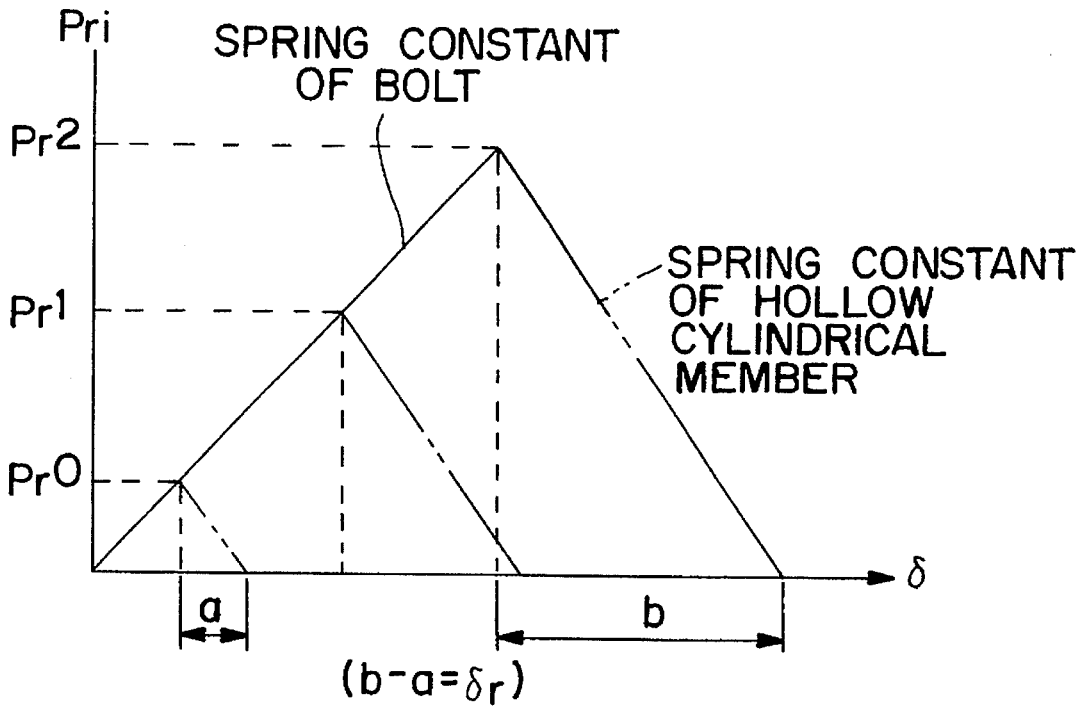
FIG. 4 is a view illustrating the relationship between the internal pressure of a cylinder apparatus and the amount of deformation of a hollow cylindrical member according to the first embodiment.

The relationship between the internal pressure Pri of the cylinder unit 30 and the amount of the contraction δ of the member 20 is illustrated in a diagram shown in FIG. 4. The absolute amounts of contraction of the hollow cylindrical member 20, when the minimum hydraulic pressure Pr0 or the maximum hydraulic pressure Pr2 are applied, are respectively designated "a" and "b" in FIG. 4. If the internal pressure Pri of the cylinder chamber 32 is changed from the minimum pressure value Pr0 to the maximum pressure value Pr2, the hollow cylindrical member 20 is deformed by the maximum relative amount of the deformation ($b - a = \delta_{02}$).

Thus, if an intermediate value (substantially median value) between the aforementioned Pr0 and Pr2 is applied within the cylinder chamber 32 as an initial internal pressure Pr1, and then the internal pressure is increased, the hollow cylindrical member 20 contracts by an amount corresponding to the increase of the internal pressure. Conversely, if the internal pressure Pri is reduced from the initial pressure Pr1, the hollow cylindrical member 20 expands by an amount corresponding to the decrease of the internal pressure.

The amount of contraction of the hollow cylindrical member 20 with respect to an arbitrary internal pressure Pri ($Pr0 \leqq Pri \leqq Pr2$) is calculated according to the value of the arbitrary internal pressure Pri.

In the present embodiment, the aforementioned internal pressure Pr1 is selected so as to be a middle value corresponding to a contraction between the minimum amount (a) of contraction of the hollow cylindrical member 20 and the maximum amount (b) of contraction thereof. Thus, irrespective of whether the bottom dead center position changes upward or downward, it is possible to correct the position accurately.

Figure 2:
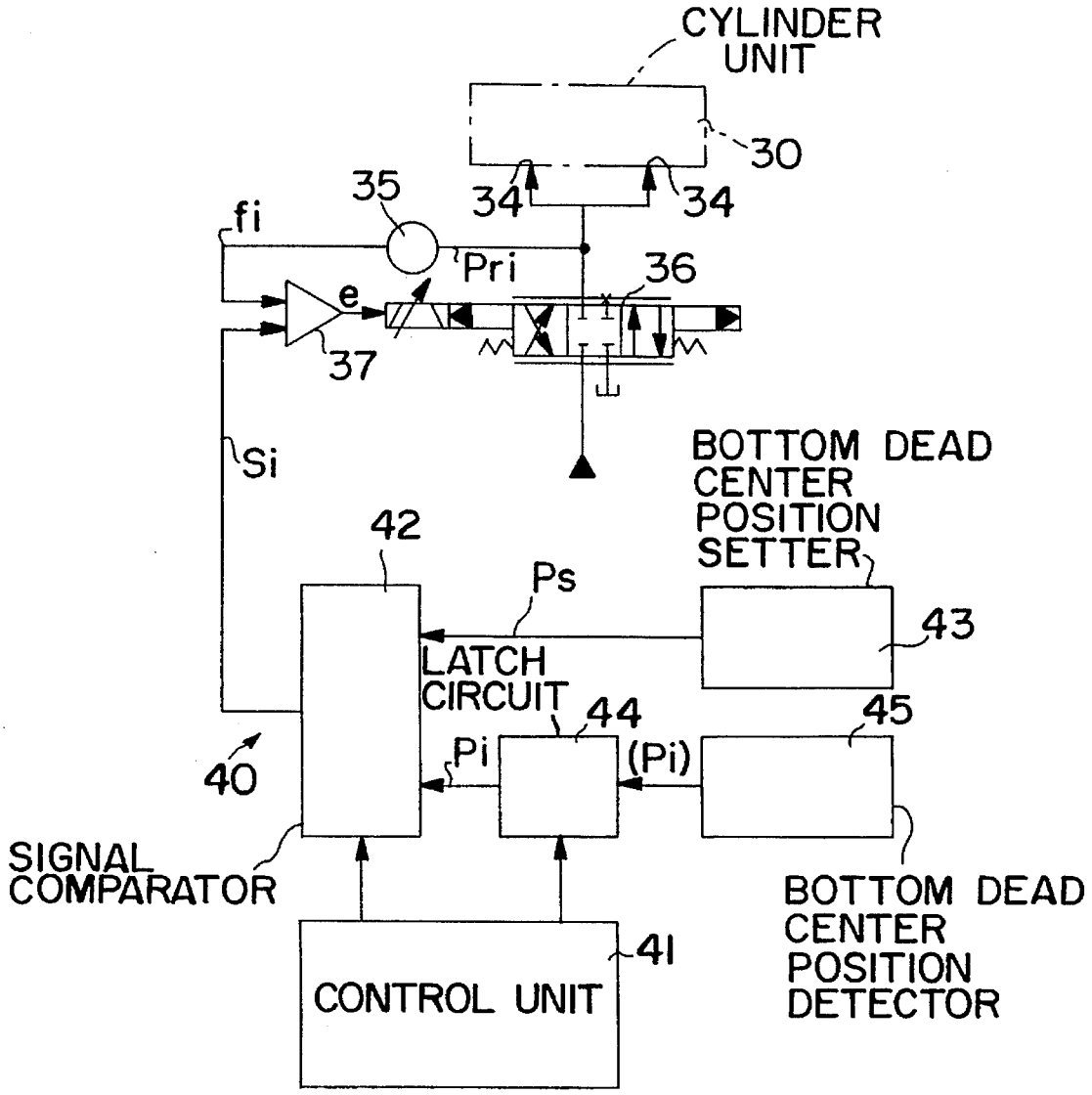
FIG. 2 is a view illustrating a hydraulic pressure supplying means and correction control means which constitute the contraction force applying means.

A correction control means controls driving of the contraction force applying means to expand or contract the hollow cylindrical member 20, so that the detected bottom dead center position coincides with a set bottom dead center position. The correction control means comprises a control unit 41 of a control panel 40 and a signal comparator 42, as shown in FIG. 2.

A bottom dead center position setter 43 outputs the set bottom dead center position signal Ps. The signal comparator 42 compares the signal Ps with an actual bottom dead center position signal Pi from the bottom dead center position detector 45. If Ps>Pi, the signal comparator 42 outputs a deviation signal Si=S2 (expansion signal) to drive the electric hydraulic type servo mechanism 36. The signal comparator 42 is contained in the control panel 40.

The signal comparator 42 is not restricted to the aforementioned case. Thus, if a previous actual bottom dead center position signal and a current bottom dead center position signal are assumed to be Pi and Pj, respectively, the signal comparator 42 outputs a deviation signal Si=S1 when (Ps - Pi)<(Ps - Pj) and outputs a deviation signal S2 when (Ps - Pi)>(Ps - Pj).

The pressure sensor 35 detects the internal pressure Pri of the cylinder chamber 32 and outputs a feedback signal fi when the signal comparator 42 outputs the deviation signal Si. A difference circuit 37 subtracts the feedback signal fi from the deviation signal Si and outputs a difference signal e to the servo valve 36. The servo valve 36 is actuated so that hydraulic pressure proportional to the difference signal e is supplied into the cylinder chamber 32 of the cylinder unit 30. When the internal pressure Pri reaches a value (>Pr1) corresponding to the deviation signal S1 (namely, when the difference between a feedback signal fi from the pressure sensor 35 and the deviation signal S1 becomes 0), the supply of hydraulic pressure is stopped. Thus, the internal pressure Pri is maintained at a value (>Pr1) which corresponds to the deviation signal S1. Similarly, when the signal comparator 42 outputs the deviation signal S2, the hydraulic pressure in the cylinder chamber 32 is discharged through the servo valve 36 until the hydraulic pressure decreases to a value (<Pr1) corresponding to the deviation signal S2.

The control unit 41 is constructed so as to output a latch signal to a latch circuit 44 when the crank angle of the mechanical press coincides with a set crank angle corresponding to the bottom dead center. Thus, the actual bottom dead center position signal Pi from the bottom dead center position detector 45 is maintained and output when the press is at bottom dead center. The control unit also outputs a control signal to the signal comparator 42. In response to the control signal the signal comparator 42 performs the comparison of signals Ps and Pi. Thus, it is possible to automatically correct changes of the bottom dead center position rapidly for each slide stroke.

Next, the operation of the first embodiment will be described. Pressurized oil within the cylinder chamber 32 is released to eliminate the tightening force of the bolt member 21, thereby loosening the lock nut 22. After this, the die-height adjusting screw mechanism is actuated to adjust the vertical position of the slide 4 relative to the connecting rod 11, thereby adjusting the die height by an amount corresponding to the die in use. The die-height adjusting screw mechanism is then activated further to move the slide 4 by a predetermined distance which compensates for the contraction of hollow cylindrical member 20 when the cylinder unit 20 is charged with the initial pressure Pr1. The set bottom dead center position signal Ps then is set to correspond to the adjusted die height, in the bottom dead center position setter 43. In this case, the output signal of the bottom dead center position detector 45, that is, the actual bottom dead center position signal Pi, is adjusted so as to be the same as the set bottom dead center position signal Ps.

After the mechanical press commences a pressing operation, and the crank angle reaches a set crank angle (corresponding to the bottom dead center position), the control unit 41 outputs the latch signal to the latch circuit 44. This latches the actual bottom dead center position signal Pi from the bottom dead center position detecting means 45. The control unit also outputs a control signal to the signal comparator 42.

The signal comparator 42 then compares the set bottom dead center position signal Ps with the latched bottom dead center position signal Pi. Ordinarily, the temperature of the press does not change for a while after startup. Therefore, the relationship of Ps=Pi is maintained, and no deviation signals S1, S2 are output. Thus, the clearance between the upper die and the lower die at the bottom dead center point is maintained at a set value. As a result, the press can produce products having a consistent predetermined accuracy.

Next, consideration is given to a case in which the position of the bottom dead center is changed due to different changes of temperature of the parts of the press. Assume that when the crank angle reaches a set value, the position of the slide 4 is lower than it should be. That is, assume that the clearance between the slide 4 and the bolster 5 is smaller than the previously set value thereof. The value of the actual bottom dead center position signal Pi accordingly will be lower than the set bottom dead center position signal Ps, i.e., Ps>Pi. Thus, a clearance between the lower die and the upper die at the bottom dead center point is changed so that, unless corrected, the accuracy of products would deteriorate.

According to the invention, the signal comparator 42 outputs the deviation signal S1 for contraction. Receiving the deviation signal, the servo valve 36 is actuated. Then the internal pressure Pri of the cylinder chamber 32 increases to a pressure value (>Pr1) corresponding to the deviation signal S1. Consequently, the hollow cylindrical member 20 is pushed so as to contract, and the slide 4 is moved upward by an amount corresponding to the deviation signal S1. As a result, the change in the bottom dead center position can be corrected automatically. This corrective action is performed each time the crank angle becomes the set crank angle.

On the other hand, assume the temperature of the mechanical press changes suddenly. This might occur, for example, if the mechanical press stops temporarily if the press speed slows due to a decrease of the power supply voltage, or the like. In some cases this may cause the bottom dead center position to move upward so that the previous actual bottom dead center position signal value Pi is less than the current value Pj. Thus, the difference (Ps - Pj) between the actual bottom dead center position signal value Pj and the set bottom dead center position signal value Ps becomes smaller than a previous difference (Ps - Pi). Consequently, the signal comparison means 42 outputs the deviation signal S2 for expansion.

Receiving this signal, the servo valve 36 is actuated so that the internal pressure Pri of the cylinder chamber 32 is reduced to a value (<Pr1) corresponding to the deviation signal S2. Therefore, it is possible to maintain the clearance between the upper die and the lower die at the bottom dead center position.

As described above, the first embodiment of the invention includes the hollow cylindrical member 20, the bolt member 21, the cylinder unit 30, the hydraulic pressure supply means, the bottom dead center point setter 43, the bottom dead center position detector 45 and the correction control means 41,42. Changes of the bottom dead center position are corrected automatically by adjusting the amount of contraction of the hollow cylindrical member 20. Thus, it is possible to automatically correct the changes of the bottom dead center position during the operation of the mechanical press with high accuracy, thereby maintaining a predetermined constant product accuracy.

The hollow cylindrical member 20 is elastically expanded or contracted in the range of $\delta_r$(=b - a) shown in FIG. 4, in order to correct the slide bottom dead center position. Thus, the slide 4 is not lowered without limit, thereby enabling the correction of the bottom dead center position.

If the hollow cylindrical member 20 is expanded or contracted, its female screw thread 20S and the male screw thread 16S of the adjusting screw shaft 16, apply pressure to each other along the axis thereof in order to fix the adjusting screw shaft 16. Thus, the bottom dead center position correcting apparatus is capable of acting as a means for fixing the adjusting screw shaft 16.

The construction of the bottom dead center position detector 45 is not restricted to the above mentioned example, other structures being possible. The construction of the mechanical press also is not restricted to that described.

Second embodiment

Figure 5:
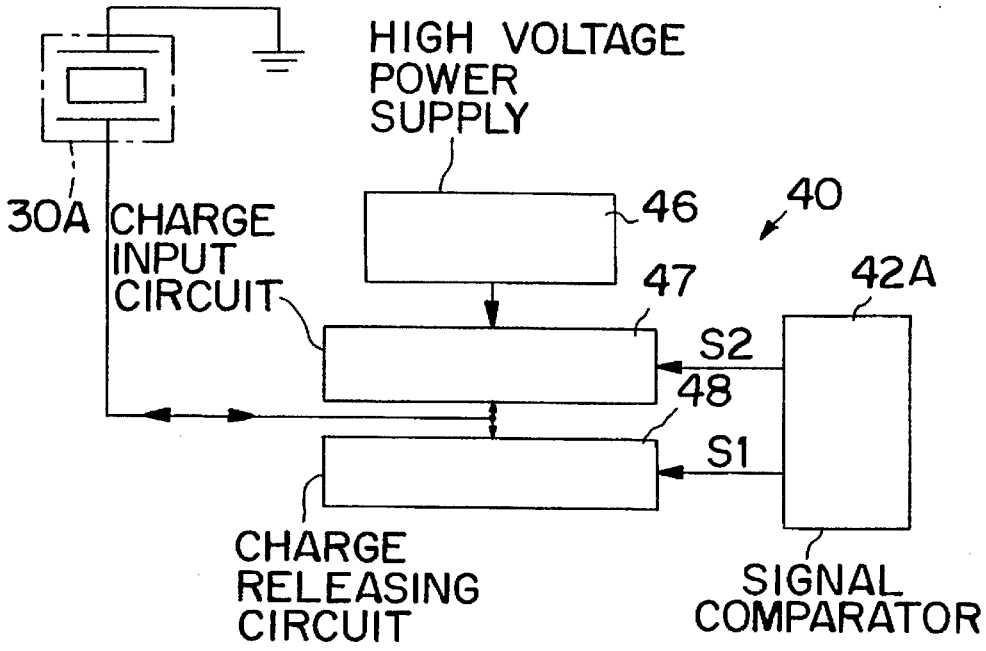
FIG. 5 is a diagram for explaining the second embodiment of the present invention.

FIG. 5 shows the second embodiment of the invention. In the bottom dead center position correcting apparatus according to the second embodiment, the contraction force applying means comprises a piezo actuator 30A and a piezo driving means for forcibly expanding or contracting the piezo actuator 30A according to the piezo electric effect, by applying a high voltage thereto. The piezo driving means includes a high voltage power supply 46, a charge input circuit 47, and a charge releasing circuit 48. The correction control means includes a signal comparator 42A for comparing the set bottom dead center position signal Ps set in the bottom dead center position setter 43, with the actual bottom dead center position signal Pi detected by the bottom dead center position detector 45. The signal comparator 42A outputs the deviation signals S2, S1 to the charge input circuit 47 and the charge releasing circuit 48. The bottom dead center position correcting apparatus drives the piezo driving means 46, 47, 48 according to the deviation signals S1, S2 to automatically adjust the amount of contraction of the length of the piezo actuator 30A.

Figure 6:
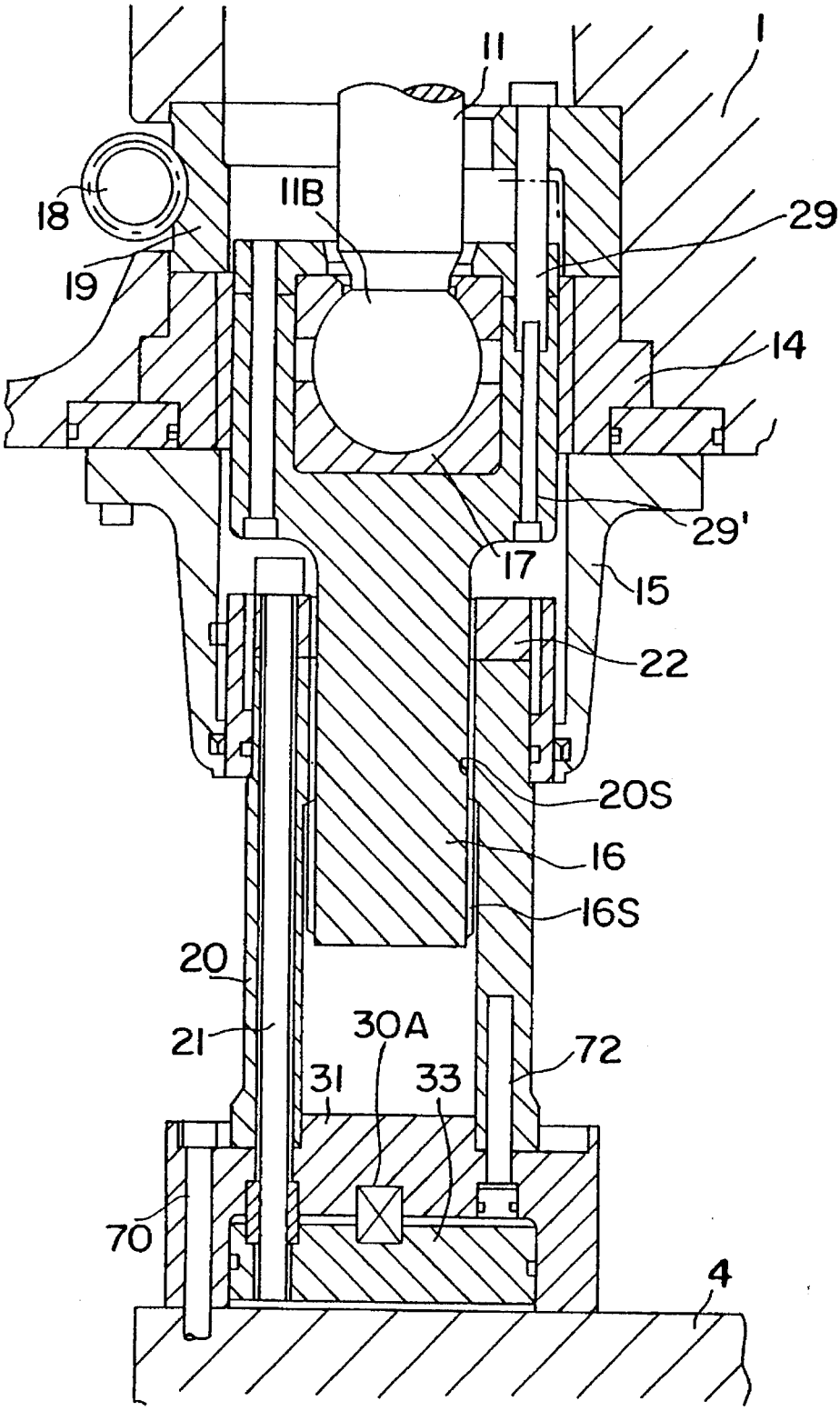
FIG. 6 is a section view illustrating the main parts of the second embodiment.

As is shown in FIG. 6, the mechanical structure of the second embodiment is similar in structure to that of the first embodiment. The contraction force applying means includes, instead of the hydraulic pressure supplying port 34, directional control valve 36 (servo valve) and a hydraulic supply source of the first embodiment, the piezo actuator 30A affixed at its top end to the cylinder 31 and at its bottom end to the piston 33. The heights of spaces shown in FIG. 6 above and below the piston 33 are exaggerated to facilitate understanding that the piston 33 is vertically movable within the cylinder 31.

By contracting and lengthening the piezo actuator 30A, adjustments are made to eliminate changes of the bottom dead center position. Moreover, as in the first embodiment, the second embodiment makes it possible to automatically correct the slide bottom dead center position rapidly and accurately while the die-height adjusting screw mechanism is fixed, even during the operation of the mechanical press.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. An apparatus for adjusting and correcting the bottom dead center position of a slide of a mechanical press, the apparatus connecting the slide to a connecting rod of the press spaced from the slide in a vertical direction, the apparatus comprising:

a screw mechanism having a top end for connection to the connecting rod and a bottom end having screw threads;

a cylindrical shrink member having a top end threadedly engaging said screw threads and a bottom end for operative connection to the slide, rotation of said screw mechanism adjusting a distance measured in said vertical direction between the connecting rod and the slide, thereby to adjust the bottom dead center position of the slide;

a lock nut for fixing said screw mechanism against rotation relative to said shrink member;

first means for applying a contraction force to said shrink member, the contraction force compressing the shrink member to reduce its length in the vertical direction, the first means additionally including means for loosening said lock nut to permit rotation of said screw mechanism for adjustment of the bottom dead center position, and for tightening said lock nut upon completion of the adjustment;

second means for detecting a bottom dead center position of the slide;

third means for setting a bottom dead center position of the slide; and control means, responsive to a detected bottom dead center position value output by said second means and a set bottom dead center position value output by said third means, for controlling said first means to correct the detected bottom dead center position to coincide with the set bottom dead center position.

2. An apparatus according to claim 1, wherein:

said lock nut is disposed above said shrink member; and said first means comprises a bolt member extending through a passage in said shrink member, said bolt member having a top end in contact with said lock nut and having a bottom end, said first means additionally comprising a cylinder unit disposed between said bottom end of said shrink member and the slide, said cylinder unit including a vertically movable piston, said piston being fixed to said bottom end of said bolt member.

3. An apparatus according to claim 1, wherein said lock nut is disposed above said shrink member, said first means including a bolt member extending through a passage in said shrink member, said bolt member having a top end in contact with said lock nut and having a bottom end;

a piezoelectric actuator, said piezoelectric actuator being disposed between said bottom end of said shrink member and the slide, said bottom end of said bolt member being fixed to said piezoelectric actuator; and a piezo driving device for expanding and contracting said piezoelectric actuator by applying high voltages thereto.

4. An apparatus according to claim 3, wherein said first means additionally comprising a cylinder unit disposed between said bottom end of said shrink member and the slide, said cylinder unit including a vertically movable piston, said piston being fixed to said bottom end of said bolt member, said piezoelectric actuator being fixed to said piston.

5. An apparatus according to claim 1, wherein said first means is disposed between said shrink member and said slide.

* * * * *